US007247047B2

(12) United States Patent
Baranski et al.

(10) Patent No.: US 7,247,047 B2
(45) Date of Patent: Jul. 24, 2007

(54) MOTOR VEHICLE GLASS PANE

(75) Inventors: Detlef Baranski, Recklinghausen (DE); Martin Derda, Bochum (DE); Peter Paulus, Muenster (DE)

(73) Assignee: Pilkington Automotive Deutschland GmbH, Witten (DE)

( * ) Notice: Subject to any disclaimer, the term of this patent is extended or adjusted under 35 U.S.C. 154(b) by 0 days.

(21) Appl. No.: 10/530,719

(22) PCT Filed: Oct. 8, 2003

(86) PCT No.: PCT/EP03/11124

§ 371 (c)(1),
(2), (4) Date: Feb. 15, 2006

(87) PCT Pub. No.: WO2004/034510

PCT Pub. Date: Apr. 22, 2004

(65) Prior Publication Data

US 2006/0234523 A1 Oct. 19, 2006

(30) Foreign Application Priority Data

Oct. 11, 2002 (DE) ..... 202 15 634 U

(51) Int. Cl.
*H01R 12/24* (2006.01)

(52) U.S. Cl. ..... 439/495

(58) Field of Classification Search ..... 430/67, 430/34, 329, 495, 493, 917
See application file for complete search history.

(56) References Cited

U.S. PATENT DOCUMENTS 4,379,608 A 4/1983 Olsson et al.
5,049,892 A 9/1991 Lindenmeier et al.
5,208,444 A * 5/1993 Winter et al. ..... 219/547
5,534,879 A 7/1996 Braun et al.

(Continued)

FOREIGN PATENT DOCUMENTS

DE 11 96 330 7/1965

(Continued)

OTHER PUBLICATIONS

German Search Report.

*Primary Examiner*—Alexander Gilman
(74) *Attorney, Agent, or Firm*—Buchanan Ingersoll & Rooney PC

(57) ABSTRACT

A motor vehicle glass pane has an electrical arrangement (3) with conductor junction areas (2) arranged one beside the other an one surface of the pane (1). A connecting element is provided which is connected to the conductor junction areas (2) and which is intended to connect the electrical arrangement (3) to a device an the motor vehicle for processing signals or voltage supply. The connecting element comprises a plug or clamping connector (10) for a flat Gable (30) which comprises a number of conductors insulated from one another. The plug or clamping connector (10) comprises an insulating flat body (11) incorporating a slot-shaped Gable fixture (12) arranged basically parallel to the surface of the pane. A flat Gable (30) with one free end (31,32) may be datachably inserted into the Gable fixture. The plug or clamping connector further comprises a number of connecting conductors (13),the Gable-side ends (14) of which lead into the Gable fixture (12),and the glass-side ends of which (15) are connectable to the conductor junction areas (2).

14 Claims, 5 Drawing Sheets

U.S. PATENT DOCUMENTS

Figure 1:
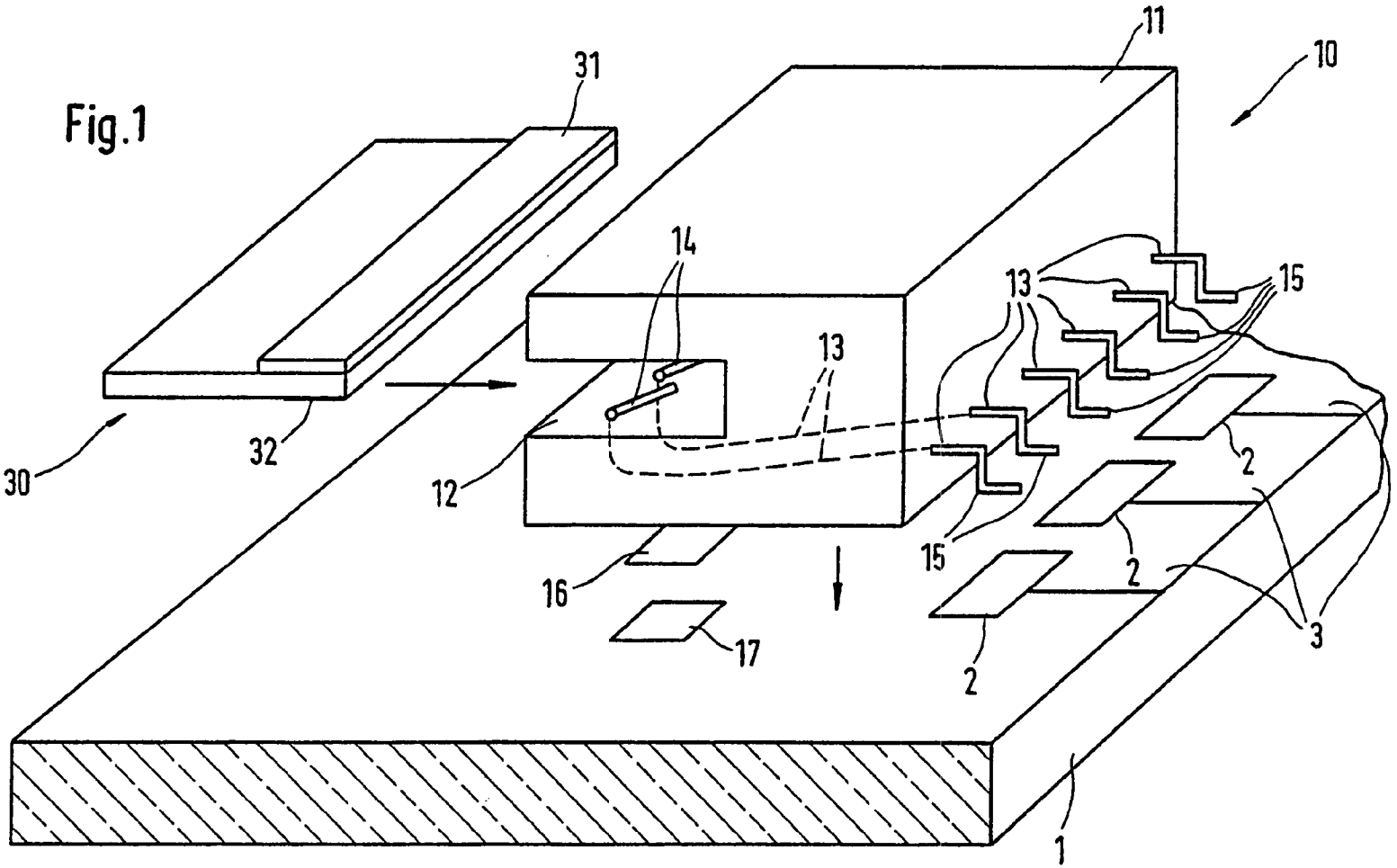

| | | | | |
|---|---|---|---|---|
| 5,598,146 | A | 1/1997 | Schroder | |
| 5,676,562 | A * | 10/1997 | Fukuda | 439/329 |
| 5,867,128 | A | 2/1999 | Sauer | |
| 5,911,597 | A | 6/1999 | Oshitani | |
| 6,089,905 | A | 7/2000 | Shimmyo et al. | |
| 6,162,083 | A * | 12/2000 | Seto | 439/328 |
| 6,307,515 | B1 | 10/2001 | Sauer et al. | |
| 6,411,259 | B1 | 6/2002 | Wendt et al. | |
| 6,638,075 | B2 * | 10/2003 | Spaulding et al. | 439/34 |
| 2001/0046804 | A1 | 11/2001 | Fuchs et al. | |

FOREIGN PATENT DOCUMENTS

| | | | |
|---|---|---|---|
| DE | 39 11 179 | A1 | 9/1991 |
| DE | 44 24 028 | A1 | 1/1996 |
| DE | 195 36 131 | C1 | 1/1997 |
| DE | 196 33 933 | | 4/1998 |
| DE | 199 20 981 | A1 | 11/1999 |
| DE | 198 23 202 | A1 | 12/1999 |
| DE | 100 14 130 | A1 | 10/2001 |
| DE | 100 30 066 | | 12/2001 |
| DE | 202 08 703 | U1 | 10/2002 |
| EP | 0 608 554 | A1 | 8/1994 |
| EP | 0 776 066 | A1 | 5/1997 |

* cited by examiner

MOTOR VEHICLE GLASS PANE

Motor vehicle glass panes are provided with different electrical elements to equip them for special functions. Such elements are, for example and without restriction, heating elements, antennas for various frequency ranges, sensors, lights, etc. The electrical elements are, amongst other things, printed onto one surface of the pane, embedded as a wiring arrangement in laminated glass panes, prefabricated as a separate component, e.g. in the form of film, and fastened to the pane, or applied in a layer to one surface or a film inserted in laminated glass panes. The majority of these electrical elements need to be connected. Thus, the electrical elements must be supplied with electrical power, or signals have to be carried from the electrical elements to signal-processing equipment located elsewhere in the motor vehicle. The connection is usually provided via connecting cables which are in most cases soldered or electrically conductively bonded direct to the electrical arrangement comprising one or more electrical elements. Plug-socket connections and capacitative or inductive connections, particularly in the case of antennas, are also known.

The more electrical elements of this kind the electrical arrangement incorporates, the more complex their connection is. It has therefore frequently been suggested that the junction points of electrical arrangements comprising a number of electrical elements be arranged one beside the other so that they can be commonly connected with the aid of a multiple connecting cable (DE 39 11 178 A1).

It has been suggested (DE 195 36 131 A1) in this connection that the connection technology known, for example, from DE 44 24 028 A1, EP 0 608 554 A1, where the flat cables with connecting conductors embedded between insulating films are soldered or electrically conductively bonded to the junction points of electrical arrangements, such as antennas or sensors, also be applied to diversity antenna arrangements.

While this connection technology has basically proved satisfactory, it is relatively costly owing to the complex process of manufacturing flat cables of this kind, which are normally tailor-made for the respective application. The cost is also higher because owing to the high temperatures arising during soldering insulating films of highly heat-resistant materials that, as in the case of polyimide (brand name: Kapton), are relatively expensive have to be used. Moreover, soldering through the insulating film in accordance with DE 195 36 131 A1 is beset with uncertainty, since the quality of the soldering point cannot be directly assessed. There is also a risk that the connecting cables soldered to the motor vehicle glass pane can be damaged or torn away when the pane is handled. Finally, soldered-on connecting cables are expensive to repair.

The invention is based on the problem of specifying a simplified and cost-effective connection solution for generic motor vehicle glass panes. The connection design must be as cost-effective as possible, extensively standardisable and easy to repair and interfere as little as possible when the pane is handled. Finally, mounting and demounting of the motor vehicle glass pane on the motor vehicle must be facilitated.

The invention enables the use of commercially available and cost-effective flat cables, particularly those sold by the metre, since the connecting cable need not be soldered and thus the use of highly heat-resistant materials may be dispensed with. At the same time it can be envisaged that, depending upon the application, only some of the individual conductors of a standard flat cable are actually used for the current supply or signal transmission.

The detachable fastening of the flat cable with the plug or clamping connector permanently fastened to the pane enables the flat cable to be attached to the glass pane either by the manufacturer of the pane or by the manufacturer of the motor vehicle when fitting the pane on the motor vehicle. It also facilitates repair and simplifies handling of the pane. The connection will have to be designed so that, when mechanical loads are applied, the flat cable detaches itself from the plug or clamping connector before the plug or clamping connector can itself be torn away from the pane.

Naturally, it is desirable that a detachable mechanical safety device be provided between the flat cable and the plug or clamping connector to reliably prevent the flat cable from becoming detached through e.g. vibration or shocks during the normal operation of the motor vehicle after plugging in or clamping of the cable. In the simplest embodiment the cable-side ends of the connecting conductors are designed as retaining elements, spring elements or claws to prevent the flat cable from being unintentionally pulled out of the cable fixture.

Alternatively or additionally to this, means of creating a detachable retention or clamping the flat cable in the cable fixture are provided for on the body of the plug or clamping connector.

In both cases it may be advisable to provide the plug or clamping connector with essentially known means of enabling the mechanical safety device to detach easily when the plug or clamping connection has to be released, for example, for repair purposes.

The plug or clamping connector can be permanently connected to the glass pane by bonding, soldering, clamping by means of clamping bars or by other means. Its body preferably incorporates at least one fastening flange with the aid of which it may be permanently fastened to the surface of the pane at an assigned fastening point by means of a bonded or soldered connection. This soldered or bonded connection will normally serve only to fasten. It is, however, within the scope of the invention to provide the surface of the connector body with a screening metal layer, or to incorporate such a layer within the body, to enable the soldered or bonded connection to function at the same time as an electrical connection between the screening and an earth conductor.

The glass-side ends of the connecting conductors of the plug or clamping connection can be connected to the conductor junction areas of the electrical arrangement in different ways. A preferred embodiment provides for a mechanical connection where the elastically deformable glass-side ends of the connecting conductors are pressed against the conductor junction areas when the connector is fastened to the glass pane. It is also preferable, to ensure a reliable connection, if two or more glass-side ends of a connecting conductor or the glass-side ends of a number of connecting conductors are connected with only one conductor junction area.

Alternatively or additionally, it is possible to connect the glass-side ends of the connecting conductors to the conductor junction areas by means of a soldered or electrically bonded connection.

To reduce susceptibility to corrosion, particularly in the case of purely mechanical connections, one embodiment of the invention provides for at least the surfaces of the conductor junction areas and glass-side connecting conductor ends coming in contact with one another to be made of the same metal, e.g. to be gold-plated. It may, however, also suffice to gold-plate only the ends of the connecting conductors and to manufacture the conductor junction areas from baked-on silver frit in the usual way.

For high frequency applications such as certain antennae, capacitative rather than galvanic contacts may be preferred between the glass-side ends and the conductor junction areas. These may be provided by interposing a thin non-conductive layer between the glass-side ends and the conductor junction areas.

The height of the plug or clamping connector should preferably not exceed 20 mm, and preferably be less than 12 mm. In this way the motor vehicle glass pane can be packed compactly and the risk of tearing away or damage during handling reduced. At the same time within the scope of the invention the plug or clamping connector will also be made as slim as possible (in the direction of flat cable insertion), while its length (corresponding to the width of the flat-strip cable used) may be considerably greater to provide a larger number of connections. The length of the plug or clamping connector should preferably regularly be at least twice its width.

The plug or clamping connector in accordance with the invention can, if appropriately designed, be used as a standard connector for a large number of applications. For this purpose it is equipped with a large number of connecting conductors arranged one beside the other, of which, if necessary, only a part is used, depending on the application. It is also within the scope of the invention to use a number of connecting conductors in such a standard connector per conductor junction area to ensure a more reliable connection and support higher currents. If the connecting conductors of such a standard connector are insufficient in the individual case, a number of such conductors can be used one beside the other or at various points on the glass pane. One preferred embodiment of the invention is particularly suitable for this purpose in that the body of the plug or clamping connector is provided in the area of its broad sides with connecting means which enable a positive connection to at least one further plug or clamping connector of the same type and thus a modular extension (cascading).

If standardisation is not a major consideration, the connecting area can be extended to include more complex functions. Thus, it is possible to provide for bridging connections between individual connecting conductors within the plug or clamping connector to replace expensive bridges or conductor crossovers on the glass surface. It is also possible to house additional components, such as coils, capacitors, filters, amplifiers, light-emitting diodes, etc. in the plug or clamping connector, although care must be taken to retain the desired low height of the connection arrangement. To ascertain whether the flat cable has been placed or inserted correctly in the cable fixture, a diagnostic device can be integrated. Thus, for example, connecting conductors which are not required can be connected one to the other via a short-circuit connection applied to the glass surface or integrated into the plug or clamping connector, thus enabling it to be ascertained, by applying a voltage to the assigned conductors of the flat cable and current measurement, whether the flat cable is properly connected.

If the connecting conductors and their glass-side ends are, as generally preferred, located very near to each other, short-circuiting or electro-corrosion may have to be avoided. In this case it may be appropriate to electrically isolate at least some of the glass-side ends from their neighbours, for example by covering at least one of them at least partially with an electrically insulating material or by providing at least one wall made of insulating material which extends from the insulating flat body of the connecting element between neighboured glass-side ends of the connecting conductors.

If the connection design in accordance with the invention is used for connecting antennas, means of screening can be provided for in the connector and also flat cables with integrated screening, pseudo-coaxial flat cables or flat cables consisting of a number of thin coaxial cables can be used.

The invention is explained below with the aid of schematic, non-scale drawings.

Shown are:

FIG. 1 a perspective view of part of a motor vehicle glass pane in accordance with the invention, with flat cable and plug connector, before final assembly, FIGS. 2-5 Cross-sectional views of different embodiments of the invention.

FIG. 1 shows a near-edge section of a motor vehicle glass pane 1. This may be of single-layer or multi-layer glass, particularly insulating or laminated glass. The term "glass" comprises organic viewing pane materials, as well as the usual inorganic glass. The motor vehicle glass pane 1 is installed in the usual way in a motor vehicle not shown here. Provided for on or in the motor vehicle glass pane 1 is an electrical arrangement 3, shown here schematically, which comprises a number of conductor junction areas 2 arranged one beside the other. The electrical arrangement 3 and the conductor junction areas 2 are normally constructed from printed and baked-on conductors of silver frit, although the invention is not limited to this. The electrical arrangement 3 normally comprises a number of individual electrical elements, for example, two or more antennas of a diversity antenna pane, receiving or transmitting antennas for various frequency ranges, heating conductors, sensors and/or lights as well as connecting conductors for connecting the electrical elements to the conductor junction areas.

Above the conductor junction areas 2 is also a plug or clamping connector 10. The plug or clamping connector 10 comprises a body 11, which can be made of insulating plastic, ceramic material, etc. It can, if required, incorporate further components, for example, a metal screening layer, fastening aids and reinforcing means. Whereas in the simplified schematic drawing in FIG. 1 the width and length of the plug or clamping connector 10 are virtually equal, normally its length is considerably greater than its width so that considerably more connecting conductors 13 than the six shown here can be arranged one beside the other.

The connecting conductors 13 project from the right-hand side of the body 11 by their glass-side ends 15 and bend stepwise towards the glass so that their end portions run more or less parallel to the surface of the pane. According to a preferred embodiment each conductor junction area 2 is assigned more than one connecting conductor 13 to ensure a more reliable connection. In the example shown the ratio of connecting conductors to conductor junction areas is 2:1. It could also be considerably higher. This enables thin connecting conductors 13 of the kind known from computer technology to be combined with considerably larger dimensioned conductor junction areas 2, which in the case of motor vehicle glass panes are preferred for production reasons. Alternatively or additionally, the connecting conductors 13 can also be equipped with divided glass-side ends 15 to enable multiple connection per conductor junction area 2.

The parts of the connecting conductors 13 located inside the body 11 are indicated by dotted lines (but, owing to the angle of view, only two of the connecting conductors 13 are shown thus). The other, cable-side ends 14 of the connecting conductors 13 project into a slot-shaped cable fixture 12, which is arranged more or less parallel to the pane and preferably on the side of the body 11 opposite the glass-side ends 15 of the connecting conductors 13 and runs the length of the plug or clamping connector 10. Again, only two of the cable-side ends 14 are visible in FIG. 1, although there are six in this embodiment.

The cable fixture 12 serves to receive a flat cable 30 shown left on the drawing. The flat cable 30 comprises a number of conductors (not shown here) arranged one beside the other with contact surfaces 32 arranged in the end area of the flat cable 30. It will normally also incorporate at least one mechanical end reinforcement 31, shown here schematically as a plastic bar running at right angles to the longitudinal extension of the cable. The end reinforcement 31 may also perform further functions, e.g. be used to mechanically secure the flat cable 30 in the cable fixture 12 or to the outside of the body 11 or to precisely and repeatably position the flat cable 30 in the cable fixture 12. It can be connected permanently or detachably to the flat cable 30. The flat cable 30 may preferably in the area of the end reinforcement 31 be fitted with handling aids e.g. in the form of eyes, hooks, recesses, etc., which facilitate the automatic handling and insertion of the flat cable 30 in the plug or clamping connector 10.

The flat cable 30 may be in particular a commercially available cable comprising a number of thin insulated single conductors arranged one beside the other and connected to one another and available by the metre or prefabricated to a particular length. It is also possible to use a laminate or extrudate made of insulating film, e.g. polyester or polyamide-based or possibly, if cost is less important, of polyimide, and conductor strips or wires embedded in between. The contact faces 32, which can e.g. be laid bare by laser radiation or crimped on as separate parts, are usually tinned or gold-plated.

FIG. 1 also shows a fastening flange 16, which projects forward from the lower edge of the plug or clamping connector 10 on the side facing the viewer. This fastening flange 16 and thus the plug or clamping connector 10 together can be permanently connected to a fastening point 17 on the surface of the pane by e.g. soldering or bonding. The fastening flange 16 can also be wider than shown, and in an extreme case run all the way round the body 11 of the plug or clamping connector 10. The provision for fastening points 17 on the surface of the motor vehicle glass pane 1 can also serve independently of the presence of a fastening flange 16 as a guide mark for manual, but particularly for automated fastening of the plug and clamping connector 10. The fastening point 17 can take the form of a ceramic imprint or thin-film or an etched or matted area. The fastening flange 16 can also be the end of a separate fastening strip laid across the body 11 of the plug or clamping connector 10.

The use of a, preferably deformable, fastening flange 16 where the plug or clamping connector 10 is not bonded by its underside full-surface or all the way round but fastened only in a limited area on the surface of the motor vehicle glass pane 1 is particularly advantageous in the case of sharply bent motor vehicle glass panes 1, in cases where the plug or clamping connector 10 regularly provided with a flat underside is arranged across the main curvature of the pane and in the case of particularly long plug or clamping connectors 10. Alternatively, the plug or clamping connector 10 may also be provided with an underside made to conform to the curvature of the pane or its body 11 formed of flexible material to permit conformity to the curvature of the pane.

Not shown is the option of providing on the broad side (that is the side of the plug or clamping connector 10 facing the viewer) connecting means which enable further similar standardised connectors to be connected up in a modular manner (cascading) and thus increase the connecting capacity without having to manufacture special designs.

Figure 2:
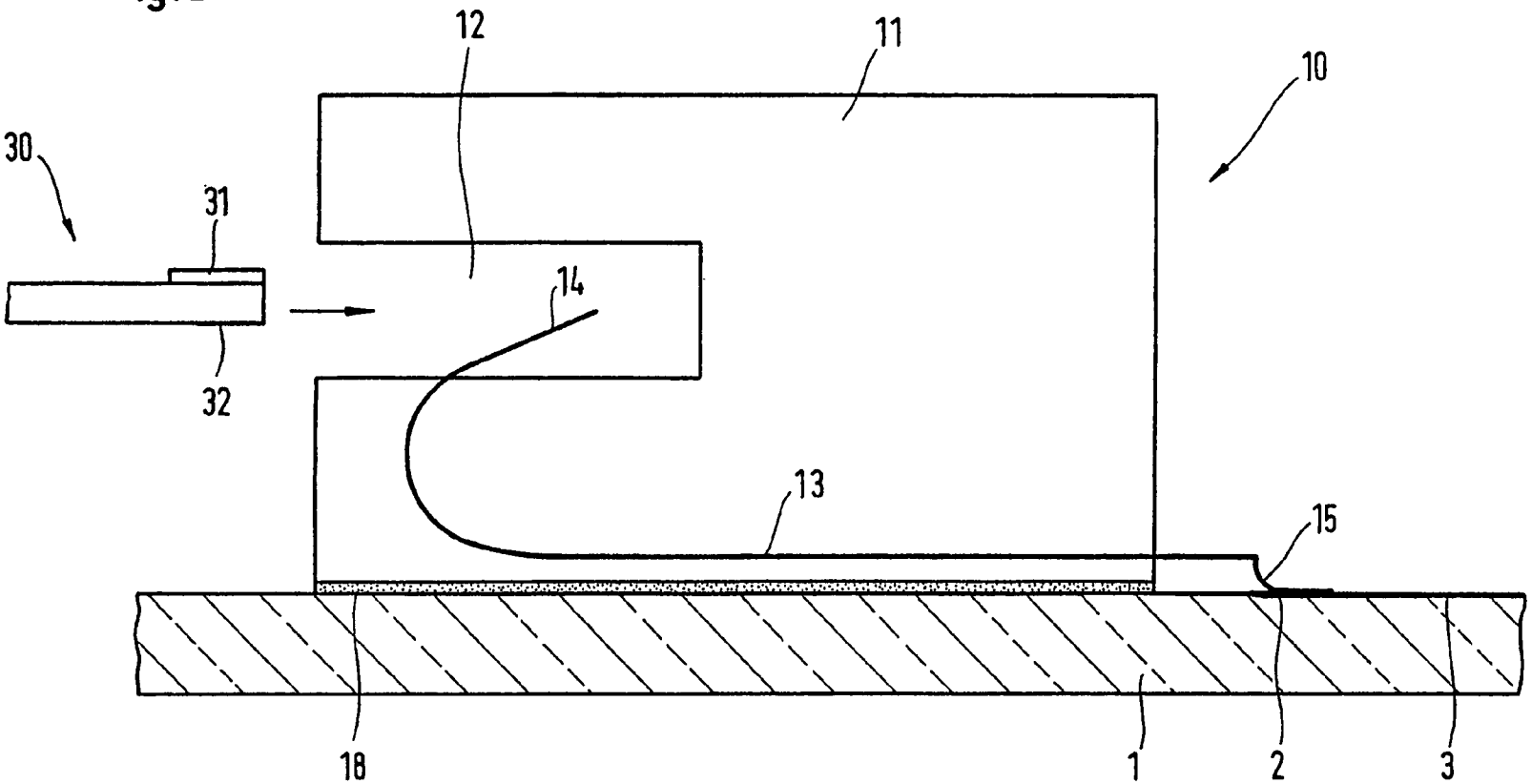

FIG. 2 shows in cross-section a first embodiment of a plug or clamping connector 10 in accordance with the invention after the body 11 has been fastened to the motor vehicle glass pane 1 and before insertion of the flat cable 30. Unlike in FIG. 1, the body 11 is permanently fastened to the motor vehicle glass pane 1 by its underside by means of a bonding medium 18, e.g. an adhesive, solder or the like. Fastening can also be effected, as in FIG. 1, via separate fastening flanges 16. The cross-sectional view also shows one of the connecting conductors 13. The glass-side end 15 of the connecting conductor 13 projects from the right-hand side of the body 11 of the plug or clamping connector 10 and is there connected to the conductor junction area 2 of the electrical arrangement 3 mechanically (by spring pressure) or a solder or electrically conductive bonding means (not shown). The cable-side end 14 of the connecting conductor 13 projects into the slot-shaped cable fixture 12 at an angle like a claw so that the flat cable 30 when inserted into the cable fixture 12 comes into contact with the cable-side end 14 by its contact surface 32 and hooks onto or grips this in such a way that the flat cable 30 can be pulled out of the plug or clamping connector 10 only by increased force.

Figure 3:
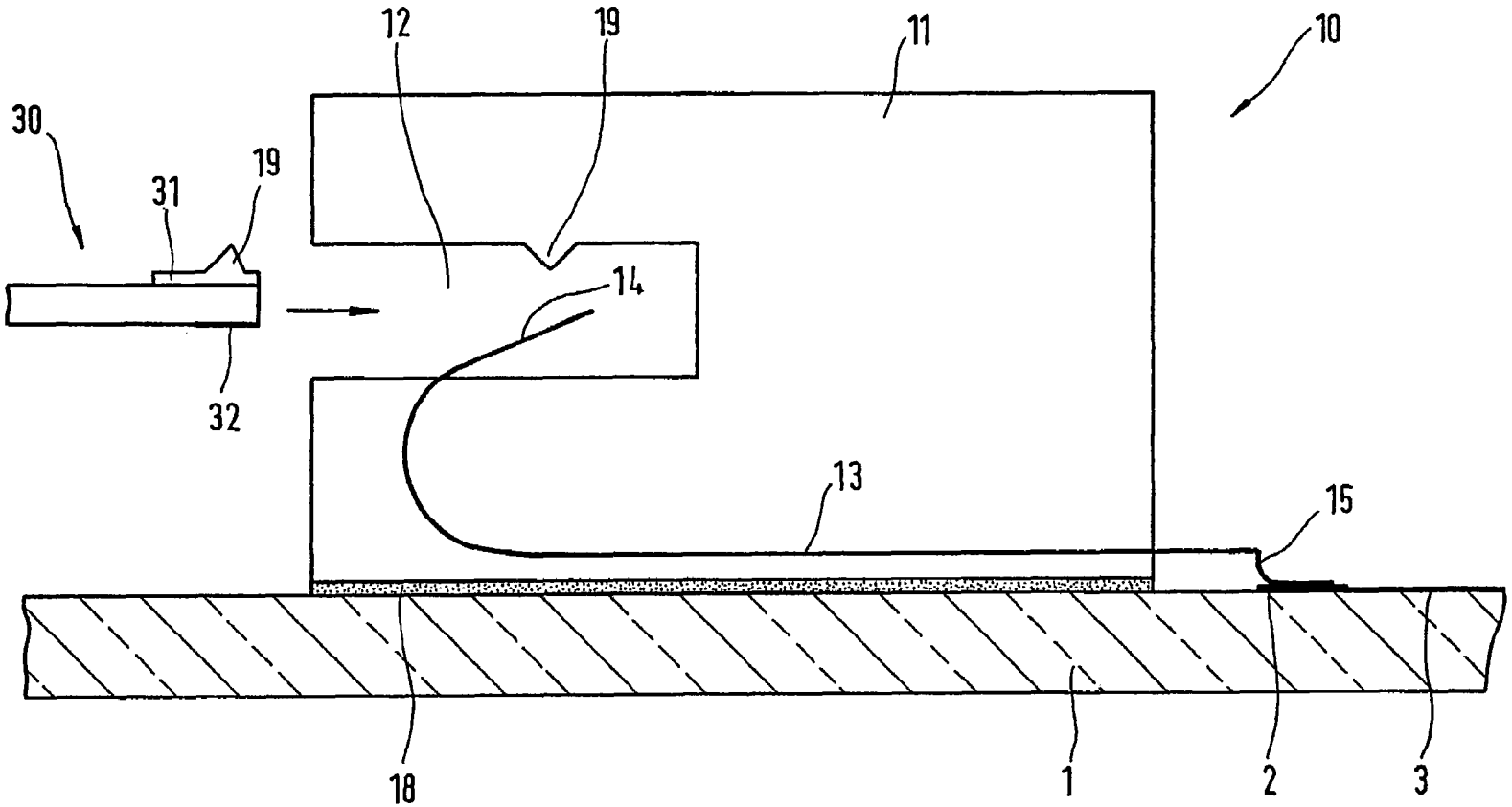

The embodiment in accordance with FIG. 3 differs from the foregoing in that, to improve the mechanical lock, corresponding catches 19 are provided on the upper side of the cable fixture 12 and in the area of the end reinforcement 31 of the flat cable 30 to ensure a better anchorage of the flat cable 30. The catches 19 are shown here and in the following drawings only as examples of mechanical locking elements. Since the expert in fastening technology is familiar with detachable locking means of this kind, further treatment can be dispensed with here. Naturally, locking need not take place only inside the cable fixture 12, it can also be effected via the outside of the plug or clamping connector 10.

Figure 4:
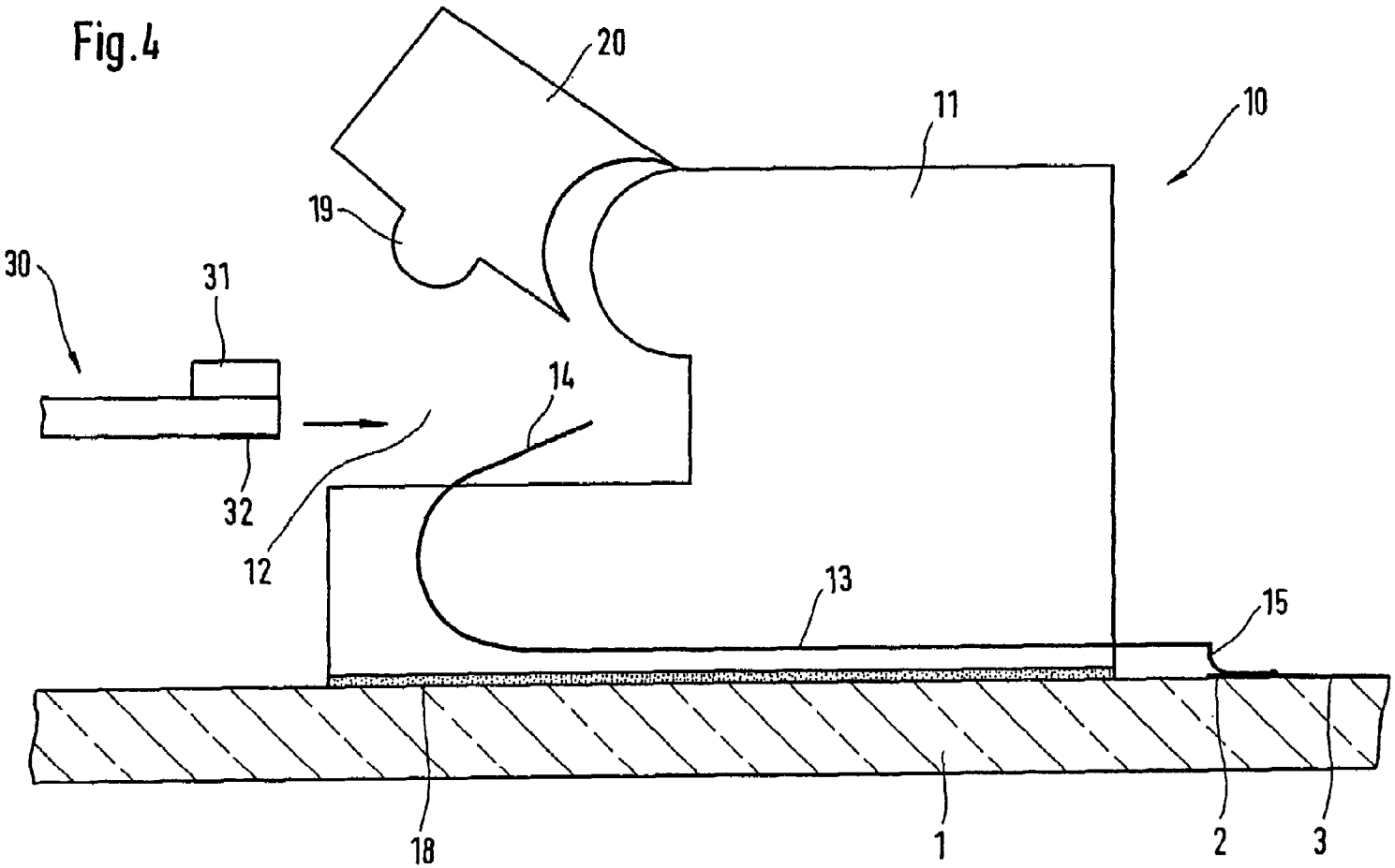

FIG. 4 shows a further embodiment of the plug and clamping connector 10 where the upper side of the cable fixture 12 is formed by a hinged and lockable clamping bar 20 which is first open before the flat cable 30 is inserted and closed afterwards. Although once again a locking anchor is shown here as a mechanical lock produced by a cylindrical catch 19 on the hinged clamping bar 20 and a thickened end reinforcement 31 of the flat cable 30, a pure clamp-fastening created by suitably dimensioning the cable fixture 12 for the flat cable 30 would suffice in this case.

Figure 5:
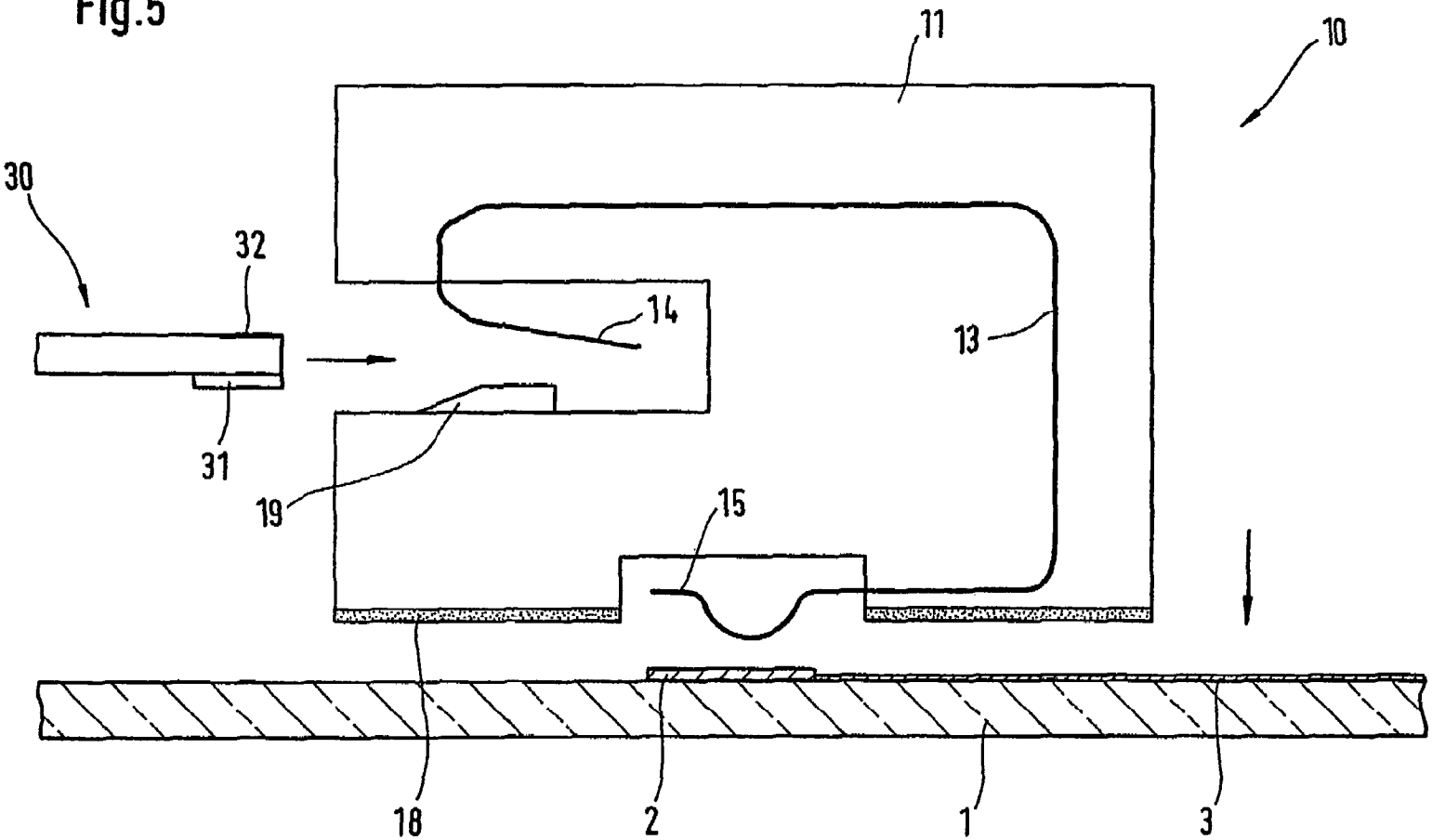

FIG. 5 shows a variant embodiment where connection to the conductor junction area 2 is effected by the glass-side end 15 of the connecting conductor 13 underneath the plug or clamping connector 10. Shown is the plug or clamping connector 10 shortly before being attached to the motor vehicle glass pane 1 in a position above the conductor junction areas 2 and the electrical arrangement 3. The connecting conductor 13 runs from the elastically deformable glass-side end 15 roughly in the form of a recumbent U to a point above the cable fixture 12 and projects into this from above by its cable-side end 14. The underside of the cable fixture 12 is provided with a catch 19. In this case the flat cable 30 must be inserted the other way round than in the preceding examples, that is, with its contact faces 32 facing upwards.

The invention claimed is:

1. Motor vehicle glass pane comprising:

an electrical arrangement with conductor junction areas arranged one beside the other on one surface of the pane and a connecting element which is connected to the conductor junction areas and which is configured to connect the electrical arrangement to a device on the motor vehicle for processing signals or a voltage supply, wherein the connecting element comprises a plug for a flat cable, wherein the flat cable comprises a number of conductors insulated from one another, and the plug comprises an insulating flat body incorporating a slot-shaped cable fixture arranged basically parallel to the one surface of the pane, wherein one free end of the flat cable may be detachably inserted in the slot-shaped cable fixture, and a plurality of connecting conductors, the connecting conductors comprising cable-side ends which lead into the slot-shaped cable fixture and glass-side ends which are connectable to the conductor junction areas.

2. Motor vehicle glass pane in accordance with claim 1, wherein the cable-side ends of the connecting conductors are designed as locking elements, spring elements or claws so as to prevent the flat cable from being unintentionally pulled out of the cable fixture.

3. Motor vehicle glass pane in accordance with claim 1, wherein means for detachably locking or clamping the flat cable in the cable fixture are provided on the body of the plug.

4. Motor vehicle glass pane in accordance with claim 1, wherein the body of the plug comprises at least one fastening flange and the body may be permanently fastened to the one surface of the pane at a fastening point by a bonded or soldered connection to the fastening flange.

5. Motor vehicle glass pane in accordance with claim 1, wherein the body is permanently joined to the one surface of the pane by a bonding medium.

6. Motor vehicle glass pane in accordance with claim 1, wherein the glass-side ends of the connecting conductors project from the plug on a side of the body opposite the slot-shaped cable fixture and are there connectable to the conductor junction areas by a soldered or electrically conductive bonded connection or mechanically by spring pressure.

7. Motor vehicle glass pane in accordance with claim 1, wherein the glass-side ends of the connecting conductors project from the plug on an underside of the body and are there connectable to the conductor junction areas by an electrically conductive bonded connection or mechanically by spring pressure.

8. Motor vehicle glass pane in accordance with claim 1, wherein at least surfaces of the conductor junction areas and the glass-side ends of the connecting conductors are made of the same metal.

9. Motor vehicle glass pane in accordance with claim 1, wherein the glass-side ends of a number of the plurality of connecting conductors or a number of glass-side ends of the plurality of connecting conductors are assigned to one conductor junction area.

10. Motor vehicle glass pane in accordance with claim 1, wherein the height of the plug does not exceed 20 mm.

11. Motor vehicle glass pane in accordance with claim 1, wherein the length of the plug greater than its width.

12. Motor vehicle glass pane in accordance with claim 1, wherein the body of the plug comprises connecting means which enable a connection to at least one further plug of the same kind.

13. Motor vehicle glass pane in accordance with claim 1, wherein the height of the plug does not exceed 12 mm.

14. Motor vehicle glass plane in accordance with claim 11, wherein the length of the plug is twice the width of the plug.

* * * * *